US009943862B2

(12) United States Patent
Lendzian et al.

(10) Patent No.: US 9,943,862 B2
(45) Date of Patent: Apr. 17, 2018

(54) CENTRIFUGAL SEPARATOR, WEAR RESISTANCE MEMBER AND SET OF WEAR RESISTANCE MEMBERS FOR A CENTRIFUGAL SEPARATOR

(75) Inventors: Willi B. Lendzian, Ballerup (DK); Hans Lauge Joakim Svarrer, Graested (DK); Henrik Reiff, Farum (DK)

(73) Assignee: ALFA LAVAL CORPORATE AB, Lund (SE)

( * ) Notice: Subject to any disclaimer, the term of this patent is extended or adjusted under 35 U.S.C. 154(b) by 782 days.

(21) Appl. No.: 13/884,797

(22) PCT Filed: Nov. 10, 2011

(86) PCT No.: PCT/DK2011/050424

§ 371 (c)(1),
(2), (4) Date: Oct. 25, 2013

(87) PCT Pub. No.: WO2012/062326

PCT Pub. Date: May 18, 2012

(65) Prior Publication Data

US 2014/0038806 A1 Feb. 6, 2014

(30) Foreign Application Priority Data

Nov. 12, 2010 (DK) ..... 2010 70483

(51) Int. Cl.
*B04B 1/20* (2006.01)
*B04B 7/12* (2006.01)

(52) U.S. Cl.
CPC ..... *B04B 7/12* (2013.01); *B04B 1/20* (2013.01); *B04B 1/2008* (2013.01); *B04B 2001/2091* (2013.01)

(58) Field of Classification Search
CPC ..... B04B 1/20; B04B 1/2008; B04B 7/12; B04B 2001/2091
(Continued)

(56) References Cited

U.S. PATENT DOCUMENTS 3,568,919 A * 3/1971 Nielsen ..... B04B 1/20 494/53
3,568,920 A * 3/1971 Nielsen ..... B04B 1/20 494/53

(Continued)

FOREIGN PATENT DOCUMENTS

CN 85104038 A 11/1986
CN 2707380 Y 7/2005

(Continued)

OTHER PUBLICATIONS

Office Action for Chilean Patent Application No. 2013-001294, dated Dec. 7, 2015.

(Continued)

*Primary Examiner* — Charles Cooley
(74) *Attorney, Agent, or Firm* — Murthia Cullina LLP

(57) ABSTRACT

A centrifugal separator includes a bowl with a conical part with a narrow discharge end comprising a radial surface; an end member opposite the radial surface; a number of distance members extending between the radial surface and the end member and providing outlet openings for a separated solid or heavy phase between adjacent distance members; and wear resistance members covering surfaces at the outlet opening. The wear resistance members include plate members and bushing members. The bushing members include mantle portions surrounding respective distance members. The plate members each cover a portion of the radial surface between adjacent bushing members.

13 Claims, 10 Drawing Sheets

(58) Field of Classification Search
USPC ..... 494/53, 54, 56; 210/380.1, 380.3
See application file for complete search history.

(56) References Cited

U.S. PATENT DOCUMENTS

| | | | | | |
|---|---|---|---|---|---|
| 3,880,346 | A * | 4/1975 | Hopfe | B04B 15/08 | 494/53 |
| 4,298,161 | A | 11/1981 | Ephithite | | |
| 4,323,190 | A * | 4/1982 | Bessette | B04B 7/00 | 494/53 |
| 4,339,072 | A * | 7/1982 | Hiller | B04B 1/14 | 494/11 |
| 4,575,370 | A * | 3/1986 | LaMontagne | B04B 1/20 | 494/53 |
| 4,764,163 | A * | 8/1988 | Caldwell | B04B 1/20 | 494/53 |
| 5,217,428 | A * | 6/1993 | Schlip | B04B 1/20 | 494/53 |
| 5,244,584 | A * | 9/1993 | Schlieperskoetter | B04B 1/20 | 209/210 |
| 5,259,828 | A * | 11/1993 | Schlieperskoetter | B04B 1/20 | 494/38 |
| 5,380,434 | A * | 1/1995 | Paschedag | B01D 33/11 | 210/360.1 |
| 5,584,791 | A * | 12/1996 | Grimwood | B04B 1/20 | 494/53 |
| 5,618,409 | A * | 4/1997 | Kreill | B04B 1/14 | 210/149 |
| 6,241,901 | B1 * | 6/2001 | Leung | B04B 1/20 | 210/360.1 |
| 6,290,636 | B1 * | 9/2001 | Hiller, Jr. | B04B 1/20 | 494/53 |
| 6,780,148 | B2 | 8/2004 | Ohinata et al. | | |
| 7,001,324 | B2 * | 2/2006 | Hensley | B04B 1/20 | 494/53 |
| 7,022,061 | B2 * | 4/2006 | Leung | B04B 1/20 | 494/56 |
| 7,077,799 | B2 * | 7/2006 | Gorham | B04B 1/06 | 494/37 |
| 7,282,019 | B2 * | 10/2007 | Lantz | B04B 1/20 | 494/53 |
| 7,374,529 | B2 * | 5/2008 | Hensley | B04B 1/20 | 494/53 |
| 7,549,957 | B2 | 6/2009 | Hruschka et al. | | |
| 7,753,834 | B2 * | 7/2010 | Figgener | B04B 1/20 | 494/53 |
| 8,157,716 | B2 * | 4/2012 | Madsen | B04B 1/20 | 494/53 |
| 8,465,405 | B2 | 6/2013 | Horstkotter et al. | | |
| 8,485,959 | B2 * | 7/2013 | Madsen | B04B 1/20 | 494/53 |
| 8,579,783 | B2 * | 11/2013 | Krammer | B04B 1/20 | 494/53 |
| 8,672,243 | B2 * | 3/2014 | Turcic | B04B 1/12 | 239/589 |
| 8,845,506 | B2 * | 9/2014 | Walraven | B04B 1/20 | 494/53 |
| 9,393,574 | B1 * | 7/2016 | Morris | B04B 1/2008 | |
| 2004/0058796 | A1 * | 3/2004 | Feldkamp | B04B 1/20 | 494/56 |
| 2004/0072667 | A1 * | 4/2004 | Leung | B04B 1/20 | 494/56 |
| 2004/0072668 | A1 * | 4/2004 | Leung | B04B 1/20 | 494/56 |
| 2004/0167005 | A1 * | 8/2004 | Hensley | B04B 1/20 | 494/53 |
| 2005/0164861 | A1 * | 7/2005 | Bruning | B04B 1/20 | 494/56 |
| 2005/0245381 | A1 * | 11/2005 | Tettleton | B04B 1/20 | 494/53 |
| 2006/0025297 | A1 * | 2/2006 | Gronnegaard | B04B 1/20 | 494/53 |
| 2006/0166803 | A1 * | 7/2006 | Schulz | B04B 1/10 | 494/56 |
| 2007/0254795 | A1 * | 11/2007 | Hensley | B04B 1/20 | 494/53 |
| 2011/0143906 | A1 * | 6/2011 | Geehan | B04B 1/20 | 494/56 |
| 2012/0245014 | A1 * | 9/2012 | Jones | B04B 1/20 | 494/37 |
| 2014/0038806 | A1 * | 2/2014 | Lendzian | B04B 1/20 | 494/56 |
| 2015/0217303 | A1 * | 8/2015 | Bauer | B04B 1/2016 | 494/4 |

FOREIGN PATENT DOCUMENTS

| | | | |
|---|---|---|---|
| JP | 2893526 | B1 | 5/1999 |
| JP | H11-267549 | A | 10/1999 |
| JP | 2003-144975 | * | 5/2003 |
| JP | P2003-144975 | A | 5/2003 |
| JP | 2005-519735 | A | 7/2005 |
| SU | 545386 | | 2/1977 |
| SU | 680764 | A1 | 8/1979 |
| SU | 1071212 | A3 | 1/1984 |
| WO | 03076078 | A1 | 9/2003 |

OTHER PUBLICATIONS

First Office Action issued in Japanese Patent Application No. JP2013-538071, dated Sep. 30, 2014.
Decision on Grant from corresponding Russian Patent Application No. 2013126587/05(039471), dated May 29, 2014.
International Search Report issued in PCT Application No. PCT/DK2011/050424 dated Jul. 19, 2012.
Search Report for corresponding Danish Application No. PA 2010 70483 date of completion Jun. 17, 2011.
Office Action for Chinese Patent Application No. 201180054410.9 dated Nov. 15, 2013.
Search Report for Chinese Patent Application No. 201180054410.9 dated Nov. 5, 2013.
Office Action for Japanese Patent Application No. 2013-538071 dated Sep. 30, 2014.
Office Action for Peruvian Patent Application No. 001053-2013 dated Sep. 5, 2017.

* cited by examiner

CENTRIFUGAL SEPARATOR, WEAR RESISTANCE MEMBER AND SET OF WEAR RESISTANCE MEMBERS FOR A CENTRIFUGAL SEPARATOR

FIELD OF THE INVENTION

The present invention relates to a centrifugal separator comprising a bowl rotatable around an axis of rotation extending in a longitudinal direction of the bowl. The bowl includes a conical part with a narrow discharge end having a radial surface; an end member opposite the radial surface; a number of distance members extending between the radial surface and the end member. Outlet openings are provided between adjacent distance members. The distance members have an axial length in an axial direction of the axis of rotation and an exterior circumferential surface perpendicular to the axial length. Wear resistance members cover surfaces defined by the outlet openings.

The invention further relates to a wear resistance member for such centrifugal separators and to a set of wear resistance members for the centrifugal separators.

BACKGROUND OF THE INVENTION

It is well known to provide wear resistance members at the solid phase or heavy phase outlet of a centrifugal separator since the solid phase separated from a feed inside the bowl of the centrifugal separator is abrasive in some applications such as drilling mud.

U.S. Pat. No. 5,244,584 discloses a centrifugal separator wherein L-shaped wear resistance members are provided to protect the surfaces of the distance members directly exposed to the out-flowing solid phase. The leg of the L-shaped member extend beyond the external surface of the bowl. The L-shaped member is fastened by a bolt inserted through the distance member and into the L-shaped member from the outside. The L-shaped member is dimensioned in a way so that it can be inserted and fitted without the bowl having to be dismantled. The L-shaped members are of a complicated construction involving many parts to be assembled.

The bowl is usually accommodated in a casing with compartments receiving the material being discharged from the outlets of the bowl, e.g., the solid phase. The solid phase may build-up in the receiving compartment until it reaches the outside of the bowl at the outlets causing abrasion of the bowl. The leg of the L-shaped member extending beyond the external surface of the bowl may act as a scraper to reduce this problem. The L-shaped members are built from several pieces and thus have a complicated construction.

U.S. Pat. No. 7,374,529 discloses another centrifugal separator wherein U-shaped wear resistance members are inserted in the outlet openings from the outside and fastened from the outside by means of bolts inserted through external flanges of the U-shaped member and fastened in the material of the bowl. The bolts thus have to counteract the centrifugal force acting on the U-shaped member. The U-shaped members extend beyond the external surface of the bowl. Spacers are fastened between the U-shaped members to the external side of the distance members by means of bolts counteracting the centrifugal force acting on the spacers. Since the material used for wear resistance members are usually brittle, using bolts introduced through the wear resistance member from the outside may cause a strength problem.

SUMMARY OF THE INVENTION

There is disclosed herein a wear resistance member including a bushing member with a mantle portion surrounding a respective distance member at least around a sufficient portion of the exterior circumferential surface of the distance member to prevent removal of the bushing member in a direction perpendicular to the axial direction. Thus, the need for bolts penetrating the wear resistance members from the outside to counteract the centrifugal force is avoided, because the bushing members are securely carried by the distance members. Providing wear members in the form of bushings requires that these wear members must be fitted on the distance members before the end member of the centrifugal separator is assembled with the conical part of the bowl. Correspondingly, dismantling is necessary in order to renew the wear members. However, using a high quality wear resistance material, renewal is needed only at such long intervals that this drawback is inferior to the benefits of the invention.

In one embodiment the mantle portion of the bushing member is tubular and circumferentially surrounds the distance member completely, resulting in an effective protection of the outside of the distance members against abrasion.

In another embodiment the mantle portion of the bushing member has a C-shaped cross-section perpendicular to the axial direction. Further the wear resistance members preferably comprise a plurality of plate members each covering a portion of the radial surface, resulting in a simple construction facilitating use of high quality wear resistance materials, such as tungsten carbide.

In one embodiment the bushing member has at one end a flange abutting the radial surface and covering a portion of the radial surface. Preferably a plate member is fitted on the radial surface between adjacent bushing members. Edges of the flanges of the bushing members overlap edges of the plate members, thereby the plate members are retained against the radial surface by the bushing members. Preferably the plate members have a waist portion, the flanges being configured to engage the waist portion and secure the plate members due to the overlap and the waist portion, to retain the plate members in both radial directions.

In one embodiment, the plate members respectively comprise an opening for a distance member to extend through, and an edge of a plate member overlaps an adjacent edge of an adjacent plate member. Preferably the plate member comprises a hole for a fastening member, and the opening for a distance member is adapted to accommodate an end of a bushing member. Due to the distance member and further the bushing member passing through and into, respectively, the opening in the plate member, the plate member is retained against the centrifugal force by the distance member together with the bushing member. Preferably the plate members are in this embodiment mounted, e.g., by means of an adhesive (e.g. glue) on a flat steel ring with corresponding holes and openings, whereby the steel ring with the plate members is secured by fasteners such as bolts inserted through the holes and tightened against rims of the holes in the steel ring without being tightened against the rims of the holes of the plate members. The plate member holes having a larger diameter than the holes of the steel ring. The fastener, e.g., a bolt, inserted through the hole in the plate member will only actively retain the plate member in case the adhesive fails and then mainly retain the plate member in an axial direction, in which direction the force acting on the plate member is small relative to the centrifugal force.

In one embodiment, a concave edge of the wear resistance members covering a portion of the radial surface includes an extension rising from a plane of the wear resistance member, whereby the extension is arranged to extend around an internal edge of the conical part adjacent the radial surface to protect the internal edge of the conical part adjacent the radial surface.

Preferably the wear resistance members comprise tungsten carbide.

Preferably the distance members, and accordingly the mantle portions of the bushing members, have a non-circular cross-section perpendicular to the axial direction preventing the bushing members from rotating around the distance members.

Preferably the mantle portion fits on the distance member with a loose fit and a filling material is provided filling the gaps between the mantle portion and the distance member. The loose fit reduces or eliminates tensions that might cause fracture of the bushing members. The filling material, such as the adhesive, results in an even distribution of the forces acting between the mantle portion and the distance member.

The object of the present invention is further obtained by a wear resistance member for a centrifugal separator. The wear resistance member is shaped as a bushing member having a mantle portion for surrounding a respective distance member at least around a sufficient portion of an exterior circumferential surface of the distance member to prevent removal of the bushing member in a direction perpendicular to an axial direction, and by a set of wear resistance members for a centrifugal separator according to the invention. The set includes bushing members having mantle portions for surrounding a respective distance member at least around a sufficient portion of an exterior circumferential surface of the distance member to prevent removal of the bushing member in a direction perpendicular to an axial direction, and plate members for covering a portion of the radial surface between adjacent bushing members.

There is disclosed herein a centrifugal separator which includes a bowl rotatable in a direction of rotation around a longitudinal axis of rotation of the bowl. The bowl includes a conical part with a discharge end having a radial surface. The centrifugal separator includes an end member opposite the radial surface. A plurality of distance members extend between the radial surface and the end member and provide outlet openings between adjacent distance members. The distance members have an axial length extending parallel to the longitudinal axis of rotation and an exterior circumferential surface extending longitudinally around the distance member. The centrifugal separator includes one or more first wear resistance member(s) having an inner surface covering at least a portion of the exterior circumferential surface of the distance member. The first wear resistance member has an axial end surface covering a first portion of the radial surface. The centrifugal separator includes one or more second wear resistance member(s) covering a second portion of the radial surface.

In one embodiment, the first wear resistance member includes a mantle that is tubular and completely circumferentially surrounds the exterior circumferential surface of said distance member.

In one embodiment, the first wear resistance member includes a mantle that has a C-shaped cross-section perpendicular to the axial direction.

In one embodiment, the second wear resistance member is a plate member.

In one embodiment, a flange extends radially outward from the first wear resistance member.

In one embodiment, the flange and the second wear resistance member engage one another via overlapping edges thereof.

In one embodiment, the second wear resistance member has a waist portion which engages the flange.

In one embodiment, the second wear resistance member has an opening extending therethrough and the distance member extends through the opening.

In one embodiment, the second wear resistance member has a hole extending therethrough to receive a fastening member.

In one embodiment, the second wear resistance member is a plate member that includes a concave edge. The concave edge has a lip extending therefrom, the radial surface has a corner formed on a radially innermost portion thereof. The lip extends over the corner to provide wear protection to the corner.

In one embodiment, the first wear resistance member and/or the second wear resistance member are tungsten carbide.

In one embodiment, the distance members and the first wear resistance member have a non-circular cross-section perpendicular to the axial direction thereby preventing the second wear resistance member from rotating around the respective distance member.

In one embodiment, the first wear resistance member is a mantle positioned around the distance member thereby defining a gap therebetween and a filling material is disposed in the gap.

The invention will in the following be described in further detail by way of example with reference to the attached schematic drawings.

DETAILED DESCRIPTION

Figure 1:
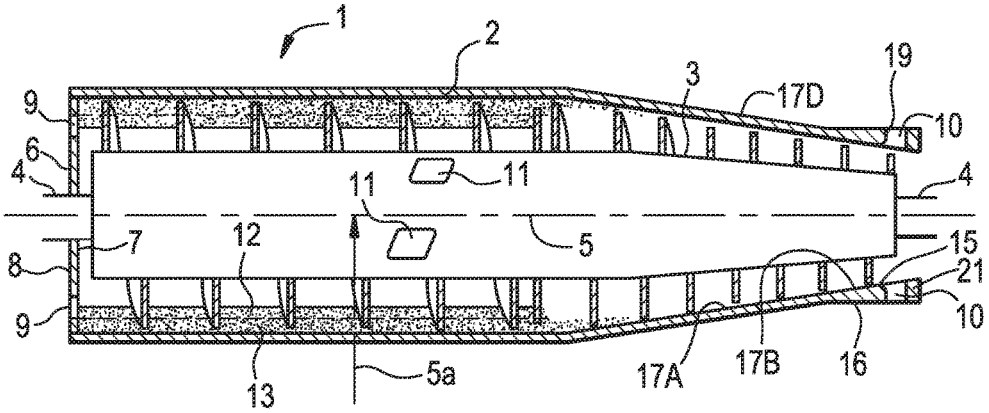
FIG. 1 is a side view of a centrifugal separator.

A rotating body 1 of a centrifugal separator or decanter centrifuge schematically shown in FIG. 1 includes a bowl 2 and a screw conveyor 3 which are mounted on a shaft 4 and are rotatable in use around a horizontal axis 5 of rotation. The axis 5 of rotation extends in a longitudinal direction of the bowl 2. Further, the rotating body 1 has a radial direction 5*a* extending perpendicular to the longitudinal direction.

For the sake of simplicity, directions "up" and "down" are used herein as referring to a radial direction towards the axis 5 of rotation and away from the axis 5 of rotation, respectively.

As shown in FIG. 1, the bowl 2 includes a base plate 6 provided at one longitudinal end of the bowl 2. The base plate 6 has an internal side 7 and an external side 8. The base plate 6 is provided with a number of liquid phase outlet passages 9 having external openings in the external side 8 of the base plate. Furthermore, the bowl 2 has solid phase discharge openings 10 (e.g., outlets) provided at an end opposite to the base plate 6.

As shown in FIG. 1, the screw conveyor 3 includes inlet openings 11 for feeding a feed, e.g., slurry to the rotating body 1. The slurry includes a light or liquid phase 12 and a heavy or solid phase 13. During rotation of the rotating body 1 as previously described, separation of the liquid phase 12 and solid phase 13 phases is obtained. The liquid phase 12 is discharged through the outlet passages 9 in the base plate 6, while the screw conveyor 3 transports the solid phase 13 towards the solid phase discharge openings 10 through which the solid phase 13 is eventually discharged.

As shown in FIG. 1, inside surfaces 17A and 17B of the bowl 2 are tapered radially inward thereby defining a conical part 17D of the bowl. The inside surfaces 17A and 17B taper radially inward along a length of the conical part 17D, towards the solid phase discharge openings 10 and terminate proximate a narrow end 15 of the inside surfaces 17A and 17B. As shown in FIGS. 1 and 2, an exterior portion 16 of the bowl 2 has a circular cylindrical cross section.

Figure 2A:
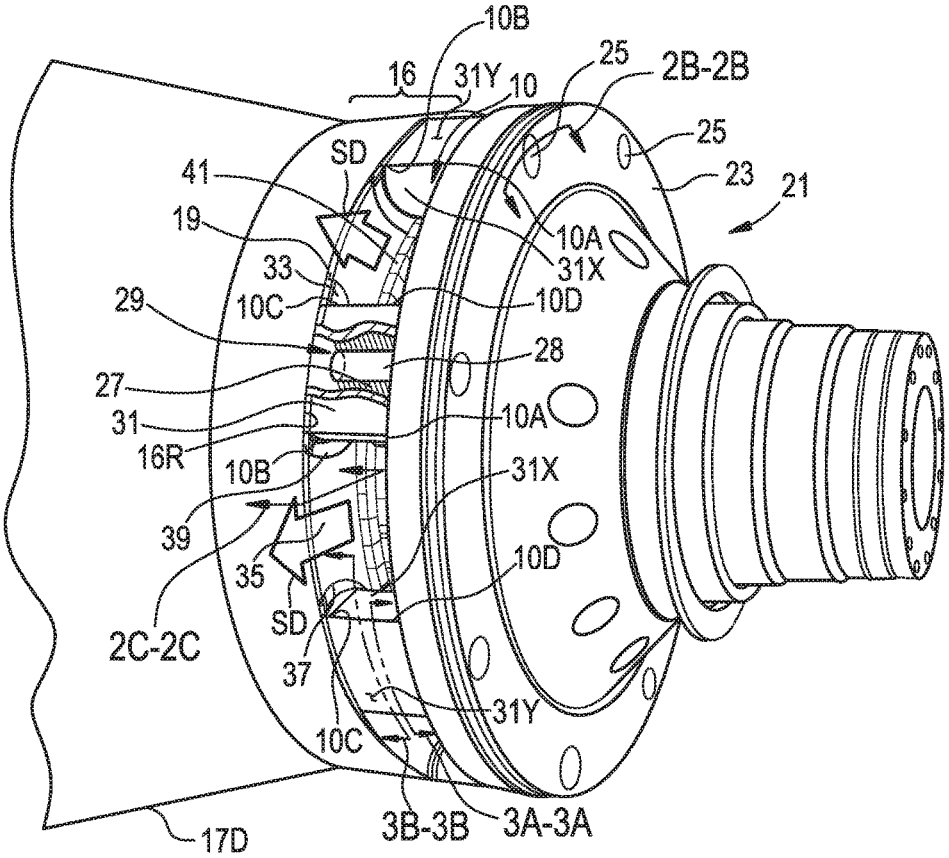
FIG. 2A is a partial perspective view of a narrow end of a conical part of the bowl and an end member fitted with wear resistance members according to a first embodiment of the present invention.

The area around the solid phase discharge openings or outlet openings 10 is shown in more detail in FIG. 2A, which shows the narrow end 15 of the bowl 2 in greater detail. The narrow end 15 has a radial surface 19 extending radially inward from the exterior portion 16. The radial surface 19 is covered by wear resistance members according to a first embodiment of the present invention, as described herein. An end member 21 of the centrifugal separator has a flange portion 23 with through holes 25 for bolts, not shown, and distance members 27 (one distance member 27 is shown in FIG. 2A in a cut away portion of thereof, also see FIGS. 2B, 3A and 3B) extending between the radial surface 19 and the flange portion 23 an axial length L1 (see FIG. 2B). The bolts (not shown) are inserted in the holes 25 and through holes 28 in the distance members 27 to be fastened to the radial surface 19 thereby mounting the end member 21 on the radial surface 19. The distance members 27 may be integral with the radial surface 19 or with the end member 21, or they may be separate elements.

As shown in FIG. 2A, the outlet openings 10 are located between the distance members 27. In particular, the outlet openings 10 have a generally rectangular cross section defined between four corners 10A, 10B, 10C and 10D. Flow of the solid phase 13 through the outlet openings 10 is designated by the arrows marked SD. The outlet openings 10 shown in FIG. 2A are fitted with wear resistance members, such as those of the first embodiment.

Figure 2B:
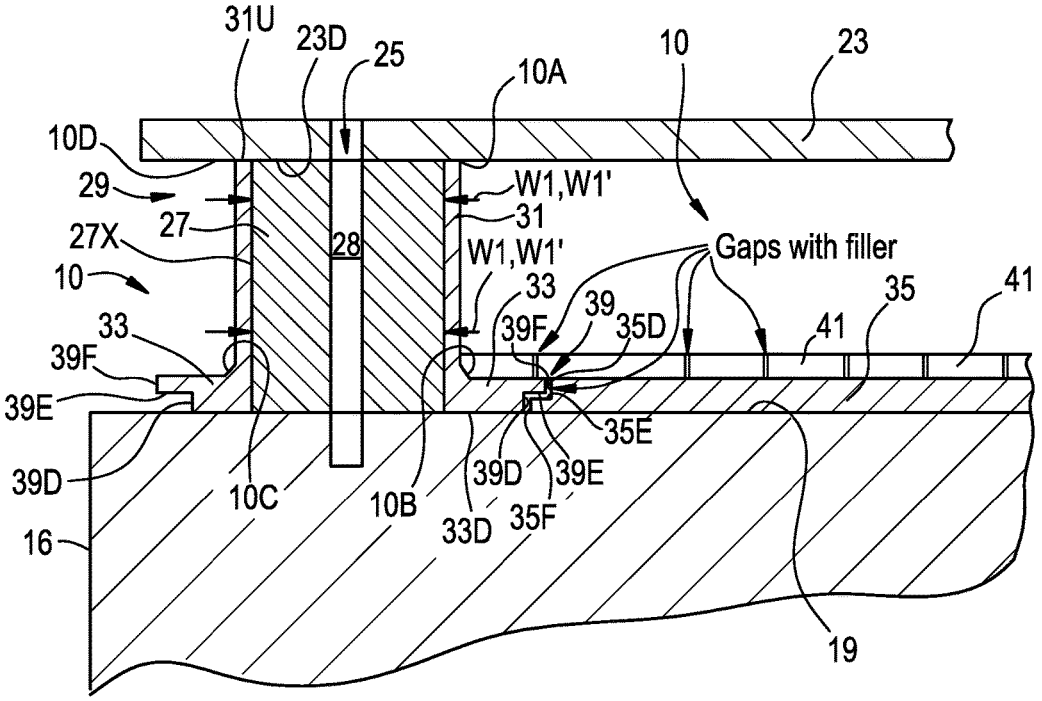
FIG. 2B is a cross sectional view of a portion of the conical part of the bowl and an end member of FIG. 2A taken across line 2B-2B.
Figure 2C:
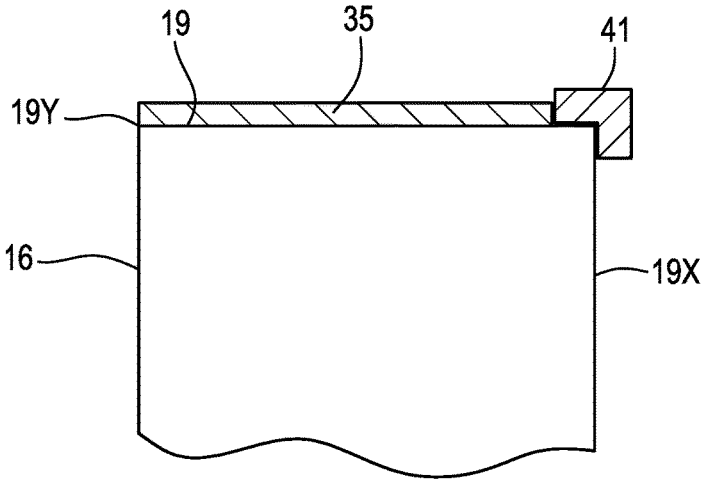
FIG. 2C is a cross sectional view of a portion of the conical part of the bowl and an end member of FIG. 2A taken across line 2C-2C to illustrate the corner pieces.
Figure 2D:
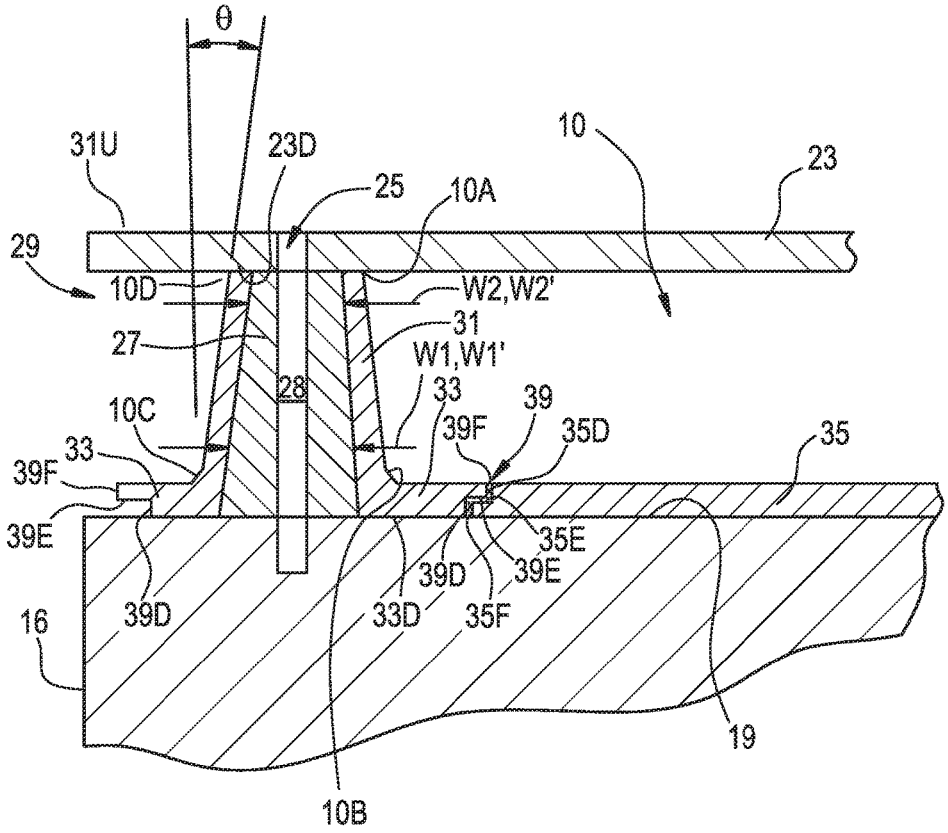
FIG. 2D is another embodiment of the narrow end of the conical part of the bowl and an end member of FIG. 2A illustrating conical distance members and bushing members.
Figure 3A:
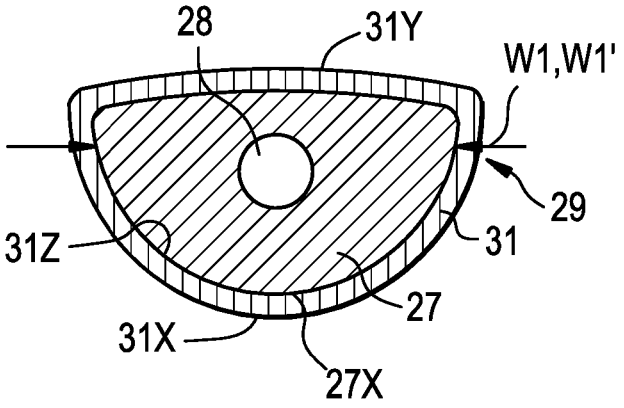
FIG. 3A is a cross section of a bushing member fitted on a distance member and taken across line 3A-3A of FIG. 2A.

As best shown in FIGS. 2B and 3A, in the first embodiment, bushing members are generally designated by the element number 29. The bushing members 29 have a tubular mantle portion 31 surrounding the respective distance member 27 such that an inner surface 31Z covers an exterior circumferential surface 27X of the distance member, as shown in FIG. 3A. Though not circular (i.e., are not right circular cylinders), the distance members 27 are cylindrical (i.e., have a surface traced by a straight line moving parallel to a fixed straight line and intersecting a fixed planar closed curve) such that a width W1 (see FIG. 2B) at any circumferential axial line is equal along that axial line. The tubular mantle portion 31 has a cylindrical shape complementary to that of the distance member 27. However, as shown in FIG. 2D, the distance members 27 and accordingly the tubular mantle portions 31 are conical, preferably slightly conical having a taper angle θ. For the first embodiment, the tubular mantle portion 31 (including the flange 33) are also referred to as the first wear resistance members, plate members 35 are also referred to as the second wear resistance members. The first wear resistance members the second wear resistance members and the corner members 41 are collectively referred to herein as wear resistance members.

Figure 3B:
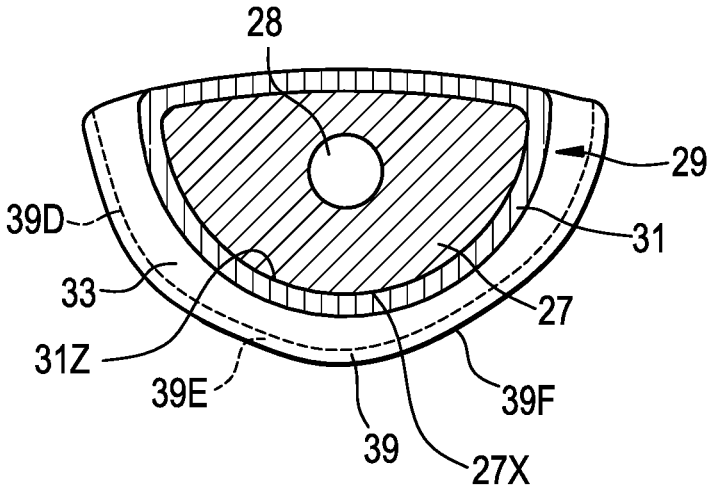
FIG. 3B is a cross section of a bushing member fitted on a distance member and taken across line 3B-3B of FIG. 2A.

As shown in FIGS. 2A, 2B and 3B, the tubular mantle portion 31 of the bushing member 29 carries at the end adjacent the radial surface 19 a flange 33 that has an axial end surface 33D abutting and covering a portion of the radial surface 19. Thus, the flange 33 extends radially outward from the tubular mantle portion 31, as best shown in FIG. 3B.

As shown in FIGS. 2A and 2B, plate members 35 are fitted onto the radial surface 19, between adjacent bushing members 29. The plate members 35 have an hourglass-shape with a waist portion 37. As best shown in FIG. 2B, the adjacent edges 39 of the flanges 33 and the plate members are stepped, whereby the edges of the flanges 33 are overlapping the edges of the plate members 35. For example, the flange 33 has an upper lip surface 39E that extends outwardly from a recess surface 39D and terminates at and edge surface 39F of the flange 33. The plate members 35 have a lower lip surface 35E that extends outwardly from a recess surface 35D and terminates at and edge surface 35F of the plate member 35. Thus, the flanges 33 are secured to the plate members 35 due to the overlap of the upper lip surface 39E over the lower lip surface 35E and the hourglass-shape of the waist portion 37. The bushing members 29 are fit between the radial surface 19 and the flange portion 23. Preferably cement, or a like filler, is used to fill any gaps between the wear resistance members and the adjacent surfaces of the bowl including the end member and especially the distance members. Such filler assist the securing of the wear resistance members and avoid rattling.

The embodiment shown in FIG. 2A further illustrates separate corner elements 41 attached by means of glue for the wear protection of the internal edge (e.g., corner) of the radial surface 19.

FIGS. 4A, 4B, 4C, 5, 6, 7 and 8 show a second embodiment of wear resistance members that are configured to be fitted at the outlet openings 10 as an alternative to the bushing members 29 and the plate members 35 shown in FIGS. 2A, 2B, 2C, 2D, 3A and 3B.

The second embodiment includes cylindrical bushing members 43 (also referred to as first wear resistance members) and plate members 45 (also referred to as second wear resistance members) that are collectively referred to herein as wear resistance members. In one embodiment the bushing members are conical to correspond to the shape of the distance members 27, similar to that shown and described with reference to FIG. 2D for the first embodiment. The wear resistance members of the second embodiment are adapted to the same centrifugal separator as the wear resistance members of the first embodiment.

Figure 4A:
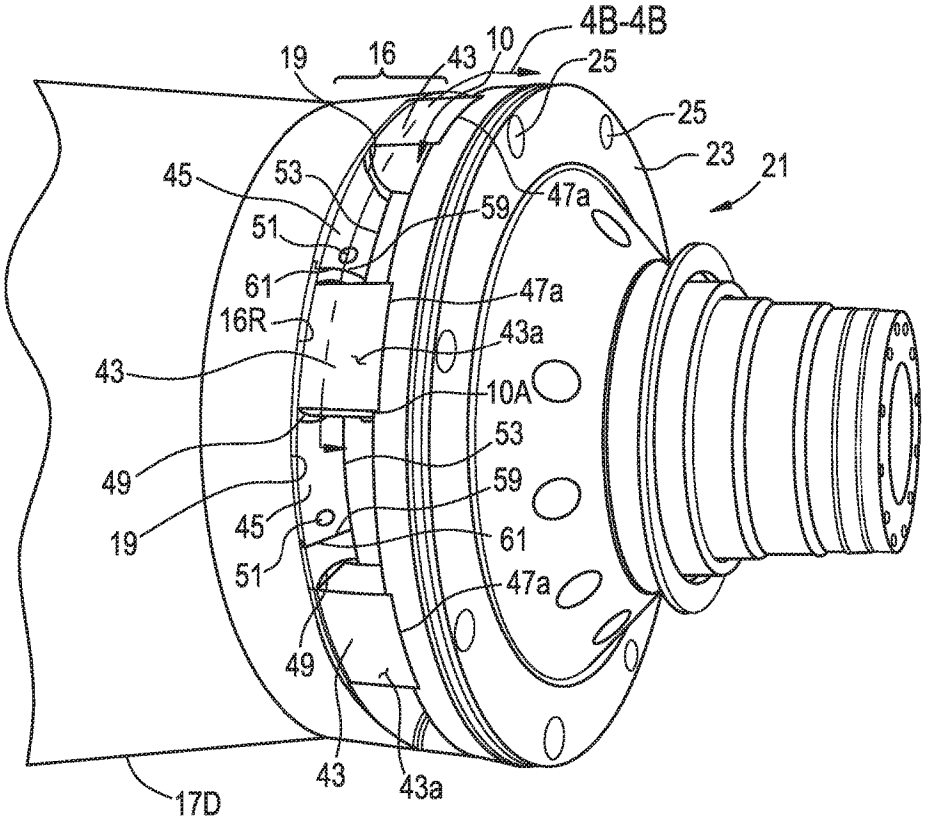
FIG. 4A is a partial perspective view of a narrow end of a conical part of the bowl and an end member fitted with wear resistance members according to a second embodiment of the present invention.
Figure 4B:
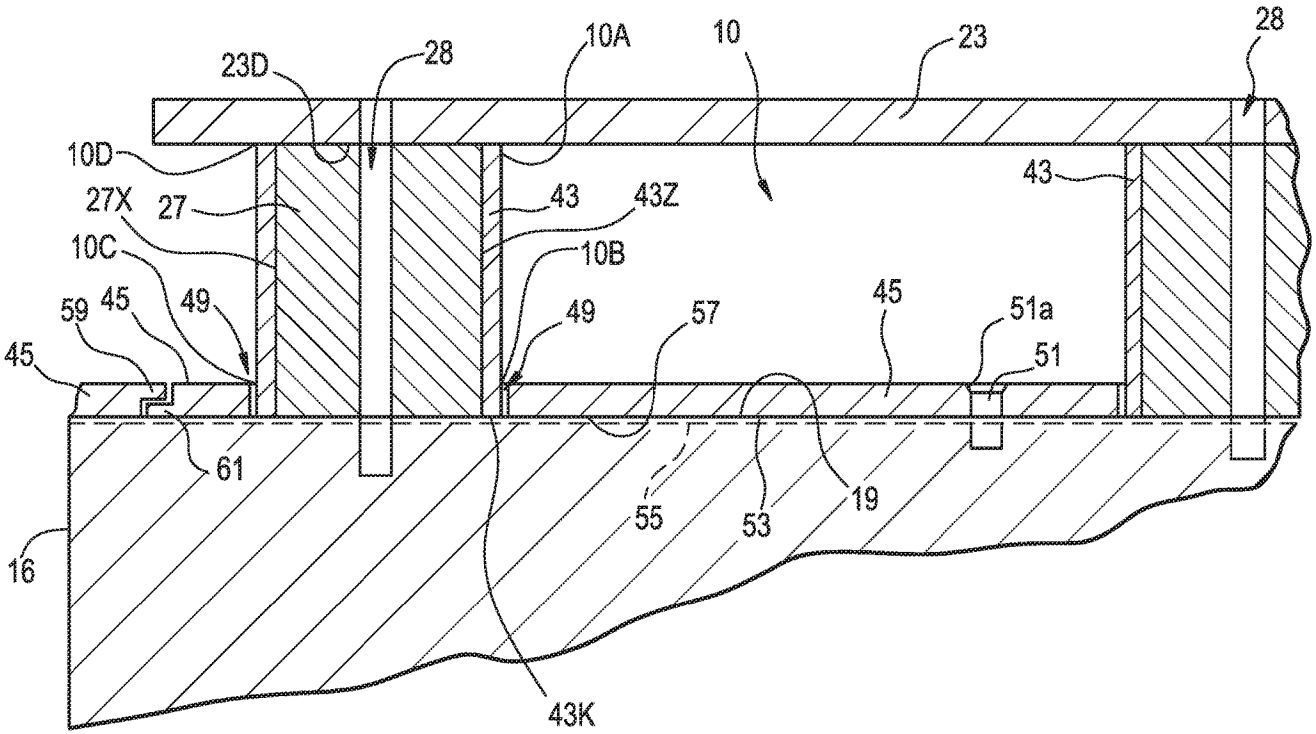
FIG. 4B is a cross sectional view of a portion of the conical part of the bowl and end member of FIG. 4A taken across line 4B-4B.
Figure 4C:
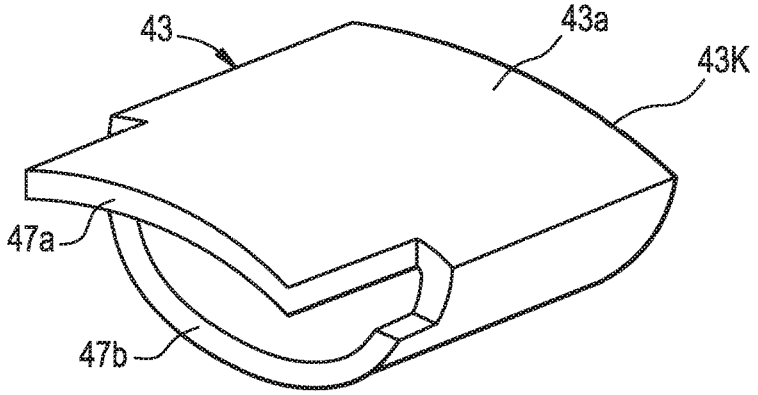
FIG. 4C is a perspective view of a second embodiment of a bushing member.
Figure 5:
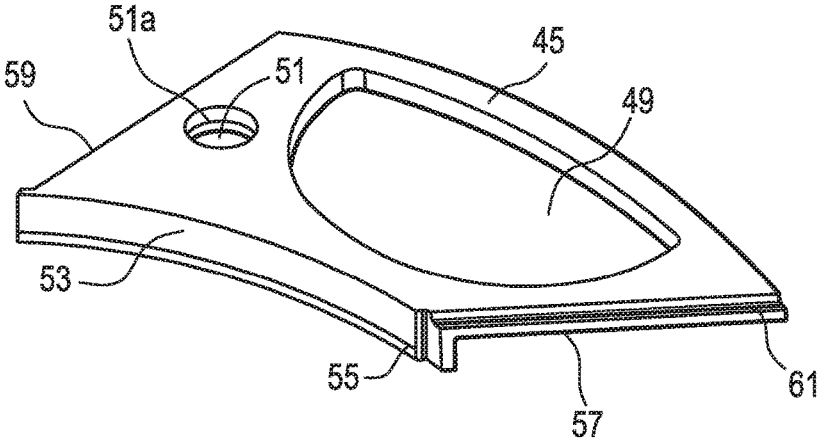
FIG. 5 is a perspective view of a second embodiment of a plate member.
Figure 6:
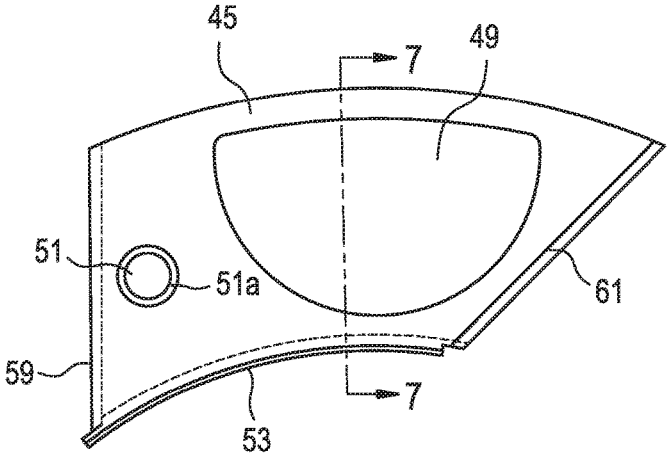
FIG. 6 is a plan view of the plate member of FIG. 5.
Figure 7:
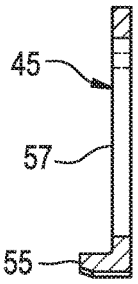
FIG. 7 is a cross-sectional view of section along line 7-7 in FIG. 6.

As shown in FIG. 4C, the cross-section of the bushing member 43 of the second embodiment is identical to the cross-section of the tubular mantle portion of the bushing member 29 of the first embodiment, as shown in FIGS. 3A and 3B. This prevents the tubular bushing member 43 from rotating around the distance member 27. The bushing member 43 has projections 47*a*, 47*b* extending from one end thereof. The projections 47*a*, 47*b* are received in recesses, not shown, in the flange portion 23. As shown in FIG. 4B the bushing member 43 has an inner surface 43Z that covers the exterior circumferential surface 27X of the distance member 27. As shown in FIG. 4B, the bushing member 43 has an axial end 43K that engages and covers a portion of the radial surface 19.

Figure 8:
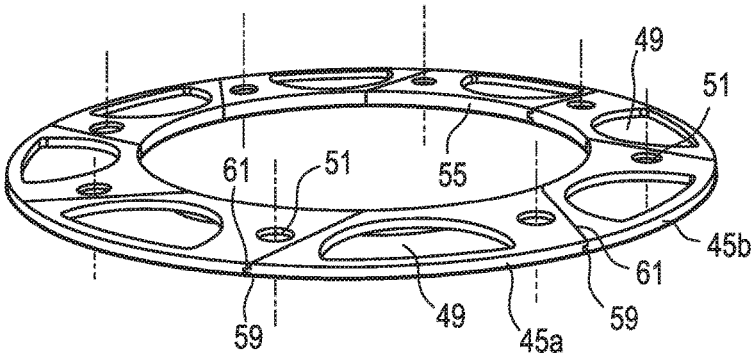
FIG. 8 is a perspective view of plate members of the second embodiment assembled into a ring.

As shown in FIG. 8, the plate members 45 are adapted to form a ring covering the radial surface 19 as best shown in FIG. 4A. The plate member 45 has an opening 49 shaped to receive the bushing member 43 with a loose fit. The plate member 45 has a hole 51 with a recessed edge 51*a* for receiving a fastening member such as a bolt (not shown).

The plate member 45 has a concave edge 53 with an extension 55 rising from the plane of the surface 57 abutting the radial surface 19 when the plate member has been mounted, whereby the extension 55 extends around the internal edge of the radial surface 19 to protect said internal edge. Accordingly, the extension 55 is similar to the separate corner elements 41 of the first embodiment as illustrated in FIGS. 2A and 2C.

At either end of the concave edge 53 the plate member has stepped edge 59, 61, whereby the stepped edges are oppositely stepped so that an edge 59 adjacent the hole 51 of one plate member 45 may overlap an edge 61 adjacent the opening 49 of a neighbouring plate member 45*b* when the plate members 45 are mounted to form a ring on the radial surface 19.

Mounting of the plate members 45 is performed as follows: The plate members 45 are assembled into a ring as shown in FIG. 8 on a flat steel ring (not shown). The steel ring comprises openings corresponding to the openings 49 for the distance members 27 to extend through and holes corresponding to the holes 51, but having a smaller diameter. The plate members 45 are fastened to the steel ring by means of, e.g., glue and the steel ring is fastened to the radial surface 19 of the narrow end of the bowl of the centrifugal separator by means of bolts with a head so shaped that the bolt is tightened against the rim of the hole in the steel ring without abutting, but only overlaying, the recessed edge 51*a* of the hole 51 in the plate member. The heads of the bolts are accommodated in the holes to be protected from wear. Overlaying the recessed edge 51*a* the head of the bolt secures the plate member to prevent its removal in case the glue should fail. The stepped edge 59 of one plate member secured by a bolt through the hole 51 will secure the opposite stepped edge 61 of the neighbouring plate member 45*b* in case the glue should fail.

Figure 9A:
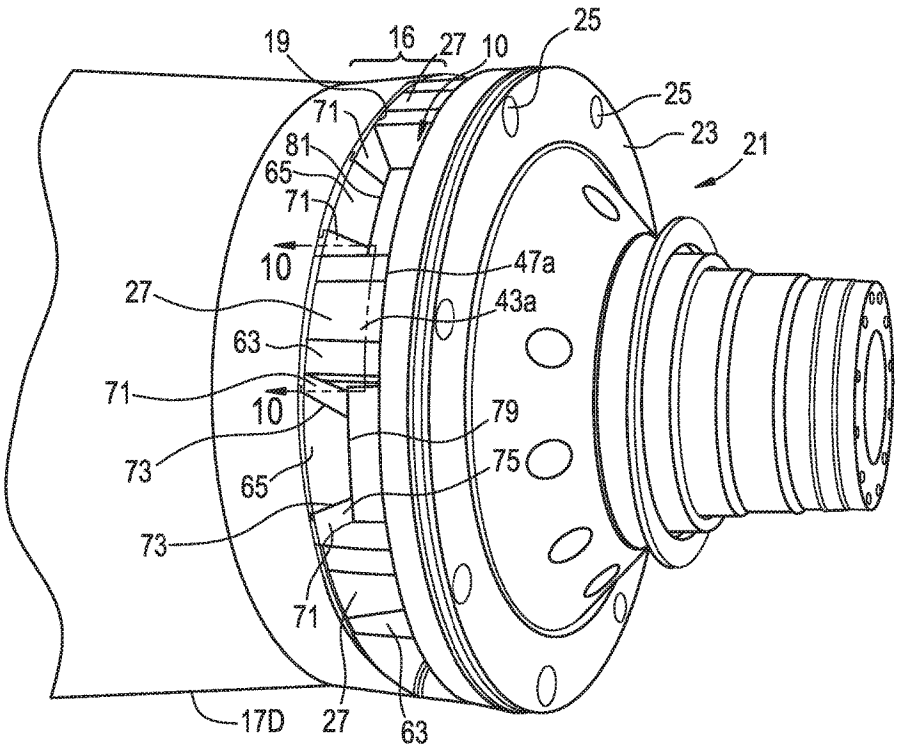
FIG. 9A is partial perspective view of a narrow end of a conical part of the bowl and an end member fitted with wear resistance members according to a third embodiment of the present invention.
Figure 9B:
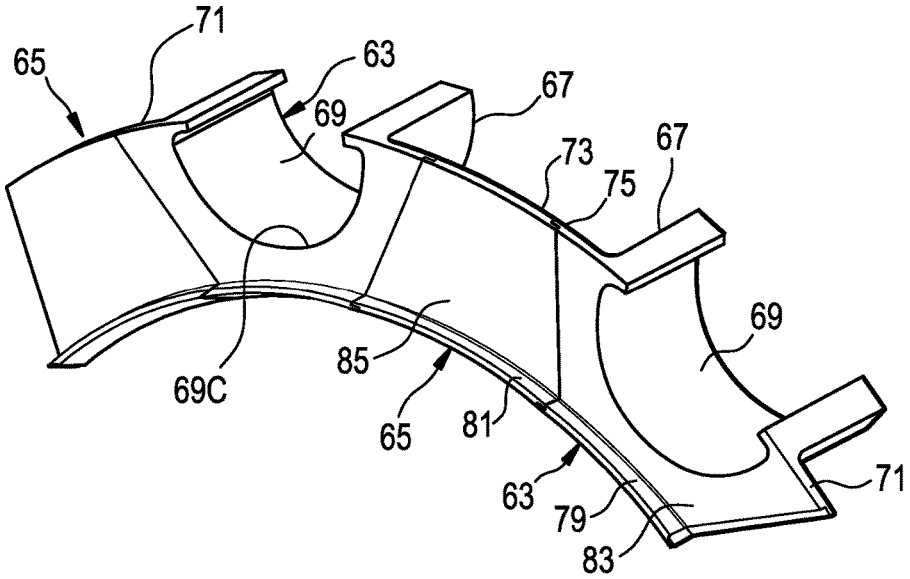
FIG. 9B is a perspective view of the bushing member and plate assembly of FIG. 9A.

FIGS. 9A and 9B illustrate four wear resistance members of a third embodiment, namely two bushing members 63 (also referred to as first wear resistance members) and two plate members 65 (also referred to as second wear resistance members). This embodiment combines various features of the first and second embodiments together with some new features. Thus, the bushing members 63 comprise a mantle portion 67 with a C-shaped cross-section. When the bushing member 63 has been mounted the mantle portion 67 will surround the distance member 27 sufficiently to prevent the bushing member 63 from being removed in a direction perpendicular to the axial direction.

Moreover, the non-circular cross-section of an inner wall 69 of the bushing member 63, which corresponds to the cross-section of the distance member 27, prevents the bushing member 63 from rotating around the distance member 27. Since the mantle portion 67 has the C-shaped cross-section, only a portion of the exterior circumferential surface 27X of the distance member is covered by the inner wall 69, as shown in FIG. 9A. The inner surface 63 has a concave edge 63C. The concave edge 63C has a flange 71 (e.g., a lip) extending therefrom. The lip extends over the corner (i.e., the internal edge of the conical part adjacent the radial surface) to provide wear protection to the corner.

Figure 10:
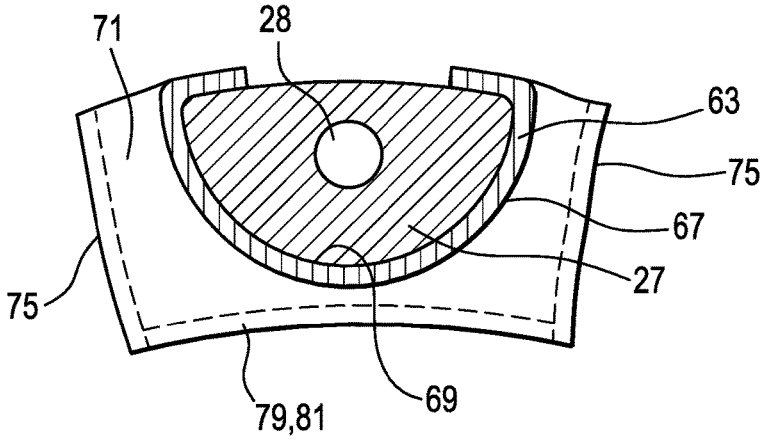
FIG. 10 is a cross sectional view of the bushing member of FIG. 9B taken across line 10-10 in FIG. 9A.

As best shown in FIG. 10, the bushing member 63, like the bushing member 29 of the first embodiment, has a flange 71 (e.g., a lip) extending radially outward from an end thereof for abutting and covering a portion of the radial surface of the narrow end of the bowl of the centrifugal separator. The plate members 65 and the bushing members have, in this third embodiment, straight overlapping adjacent edges. Thus, the plate member 65 has stepped edges 73 and the bushing member has overlapping stepped edges 75. Thus, when mounted, the bushing members 63 secure the plate members in the axial direction and in the downward radial direction. The bushing member 63 and the plate member 65 further have, at their concave edges, respective extensions 79, 81 rising from the plane of the adjacent surfaces 83, 85, respectively. The surfaces 83, 85 engage and cover respective portions of the radial surface 19. These extensions 79, 81 correspond to the extensions 55 of the plate members 45 of the second embodiment.

The straight overlapping edges 73 and 75 extend along the ends of the extensions 79, 81, and thus the bushing members 63 also secure the plate members 65 in the upwardly radial direction.

It should be noted that further combinations of features of the three embodiments are possible. For example in the third embodiment it would be possible to use tubular mantle portions surrounding the distance members completely, like in the first embodiment.

Although this invention has been shown and described with respect to the detailed embodiments thereof, it will be understood by those skilled in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the appended claims.

What is claimed is:

1. A centrifugal separator comprising:

a bowl rotatable in a direction of rotation around a longitudinal axis of rotation of said bowl, said bowl comprising a conical part with a discharge end for a separated solid or heavy phase comprising a radial surface;

an end member opposite the radial surface;

a plurality of distance members extending between the radial surface and the end member and providing outlet openings between adjacent distance members, said distance members having a length extending generally parallel to the longitudinal axis of rotation and an exterior circumferential surface extending around the length of the distance member;

a plurality of first wear resistance members each having an inner surface covering at least a portion of the exterior circumferential surface of a respective one of said plurality of distance members and each of the plurality of first wear resistance members having an axial end surface covering a first portion of the radial surface of the bowl; and a plurality of second wear resistance members each covering a respective second portion of the radial surface of the bowl and disposed adjacent to the axial end surface of the first wear resistance members.

2. The centrifugal separator according to claim 1, wherein each of the plurality of first wear resistance member comprises a mantle that is tubular and completely circumferentially surrounds the exterior circumferential surface of a respective one of said plurality of distance members.

3. The centrifugal separator according to claim 2, wherein the mantle is positioned around the distance member thereby defining a gap therebetween and a filling material is disposed in the gap.

4. The centrifugal separator according to claim 1, wherein each of the plurality of first wear resistance members comprises a mantle that has a C-shaped cross-section perpendicular to the axial direction.

5. The centrifugal separator according to claim 1, wherein each of the plurality of second wear resistance members comprises a plate member.

6. The centrifugal separator according to claim 5, wherein the plate member comprises a concave edge, the concave edge having a lip extending therefrom, the radial surface having a corner formed on a radially innermost portion thereof, the lip extending over the corner to provide wear protection to the corner.

7. The centrifugal separator according to claim 1, wherein the axial end surface comprises a flange extending radially outward from each of the plurality of first wear resistance members.

8. The centrifugal separator according to claim 7, wherein the flange and respective ones of the plurality of second wear resistance members engage one another via overlapping edges of the flange and the second wear resistance members.

9. The centrifugal separator according to claim 8, wherein each of the plurality of second wear resistance members has a waist portion which engages the flange.

10. The centrifugal separator according to claim 1, wherein each of the plurality of second wear resistance members comprises an opening extending therethrough, a respective one of the plurality of distance members extending through the opening.

11. The centrifugal separator according to claim 1, wherein each of the plurality of second wear resistance members comprises a hole extending therethrough, the hole being configured to receive a fastening member.

12. The centrifugal separator according to claim 1, wherein at least one of the first wear resistance members and the second wear resistance members comprise tungsten carbide.

13. The centrifugal separator according to claim 1, wherein each of the plurality of distance members and each of the plurality of first wear resistance members have a non-circular cross section perpendicular to the axial direction thus preventing the respective second wear resistance member from rotating with respect to the respective distance member.

* * * * *